US005520212A

United States Patent [19]

Williams

[11] Patent Number: 5,520,212

[45] Date of Patent: May 28, 1996

[54] SELF WINDING HOSE REEL

[76] Inventor: Ray F. Williams, Box 30, Ozark Dr., Arnold, Mo. 63010

[21] Appl. No.: 416,088

[22] Filed: Apr. 4, 1995

[51] Int. Cl.[6] ..... B65H 75/34

[52] U.S. Cl. ..... 137/355.23; 137/355.16; 137/355.27

[58] Field of Search ..... 137/355.23, 355.27, 137/355.26, 355.16

[56] References Cited

U.S. PATENT DOCUMENTS

| | | | |
|---|---|---|---|
| 979,382 | 12/1910 | Coonradt . | |
| 1,034,285 | 7/1912 | Olsson . | |
| 1,117,357 | 11/1914 | Esser . | |
| 1,195,644 | 8/1916 | Beard . | |
| 1,227,466 | 5/1917 | McDowell | 137/355.23 |
| 1,537,637 | 5/1925 | Jarvis . | |
| 1,675,140 | 6/1928 | Schenderlein . | |
| 1,908,852 | 5/1933 | Lea . | |
| 1,993,617 | 3/1935 | Nason . | |
| 2,563,714 | 8/1951 | Foster . | |
| 2,907,534 | 10/1959 | Benstein . | |
| 3,889,896 | 6/1975 | O'Hara | 242/86 |
| 4,543,982 | 10/1985 | Wolfe | 137/355.2 |
| 4,768,546 | 9/1988 | Brusadin et al. | 137/355.27 |
| 4,777,976 | 10/1988 | Johnston et al. | 137/355.27 |
| 4,793,376 | 12/1988 | Hare | 137/355.23 |
| 5,381,820 | 1/1995 | Chandler | 137/355.23 |
| 5,390,695 | 2/1995 | Howard | 137/355.27 |

*Primary Examiner*—A. Michael Chambers
*Attorney, Agent, or Firm*—Haverstock, Garrett and Roberts

[57] ABSTRACT

A device for winding and unwinding a hose including a frame for rotatably supporting a spool on which the hose is wound and unwound, a conduit having a portion attached to the spool for rotation therewith and a portion extending therefrom through a journal that rotatably supports the spool and a fitting connector for connecting the conduit to a water source, the fitting having first and second connector portions which are rotatable relative to each other.

11 Claims, 2 Drawing Sheets

SELF WINDING HOSE REEL

BACKGROUND OF THE INVENTION

The idea of having a self-winding hose reel device is well known in the art. It is also well known in the art, to mount such a device on a wheeled structure so that it can be moved from place to place for convenience. One of the main problems with known hose reel devices, however, is that when you make a connection between the device and a source of water, such as a hose fitting on a house or the like, the connection of the hose to the fitting makes it difficult to wind the hose up and still maintain the connection to the water source. Typically, the connection will rotate with the winding of the hose which causes the connection to kink and bind and thus, does not allow for efficient use. The present invention overcomes this deficiency by using a known snap on type water coupling device which has an annular seal and enables one of the connected portions of the fitting to rotate relative to the other. By so providing, it is possible to construct a self-winding hose reel that is portable and is also able to be connected to a hose fitting, which allows one side of the fitting connection to rotate relative to the other side when the reel on which the hose is wound, is rotated to wind or unwind the hose thereon. Such a fitting makes it possible to provide a self-winding hose reel which is easy to connect to a source of water and yet provides means whereby as the hose is drawn out or wound up, there will be no twisting or binding of the connection hose and hence, the hose will be able to be wound or unwound more easily.

SUMMARY OF THE INVENTION

The present invention resides in a mobile hose reel construction that allows the user to maintain any desired length of garden hose extending from the reel device and yet enables the reel to rotate without twisting or requiring an excessive amount of connection hose between the reel and water source in order to enable the reel to rotate sufficiently and to make the device adaptable for holding and extending different predetermined lengths of hose including substantial lengths. The present device includes a frame mounted on wheels or the like and includes means for supporting a rotating spool onto which to wind or unwind the hose to a desired length as required.

OBJECTS OF THE INVENTION

An object of the invention is to provide a hose reel device that is readily mobile and can be easily moved from one point to another.

Another object of the invention is to provide a hose reel device that has a sealed connection member that delivers water without leaking, which sealed connection member has a first portion that is fixedly attached to the spool and is able to rotate relative to a second portion that connects to a water supply source.

Another object of the invention is to provide a hose reel device including a spool mounted for rotation on a frame structure, the spool having a conduit mounted therein, the first end of which is attached to the hose to be wound on the spool and the opposite end of which extends through the journal means that rotatably supports the spool.

Yet another object of the invention is to provide a connection member that is easily attachable and detachable from a water source.

Another object of the invention is to provide a sealed conduit for connection to a fitting attached to a water source conduit which allows the conduit to rotate relative to the water source conduit.

Another object is to provide a tubular fitting which extends through the journal on one side of the spool, the hose fitting having one end connected to the hose to be mounted on the spool and the opposite end for connection to a rotatable fitting connected to a source of water.

These and other objects and advantages of the present invention will become apparent after considering the following detailed specification covering preferred embodiments in conjunction with the accompanying drawings.

DETAILED DESCRIPTION OF PREFERRED EMBODIMENTS

Figure 1:
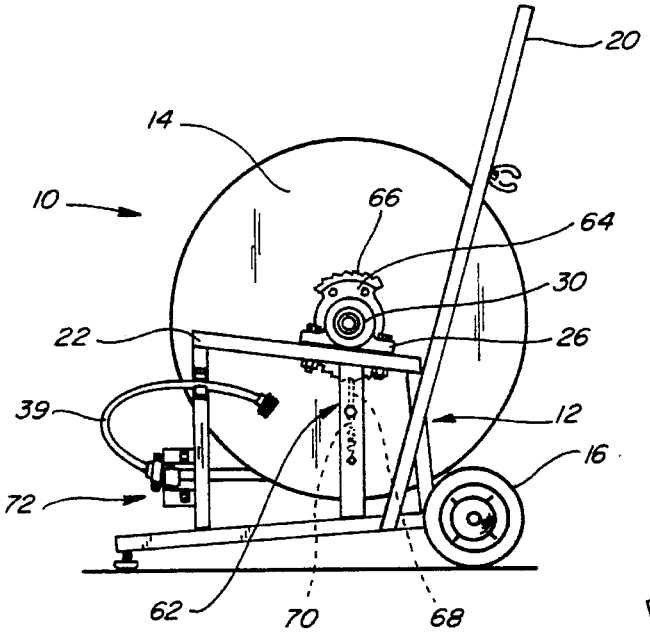
FIG. 1 is a side elevational view of the hose reel device shown with the connection member and the ratchet and pawl assembly located on the side of the spool.

Referring to the drawings more particularly by reference numbers, number 10 refers to a hose reel device constructed according to the teachings of the present invention. The hose reel device 10 provides the user with a convenient and transportable means for supporting a hose in a desired extended position. To extend or retract the hose a spool 14 on which the hose is mounted may rotate in either opposite direction without twisting or binding the hose. Further, the hose reel device does not require that the hose be disconnected from the source of water when the hose is being wound in or out. The subject device is also readily transportable and can be relocated and reconnected to a water source at a different location easily and with minimum effort.

Figure 4:
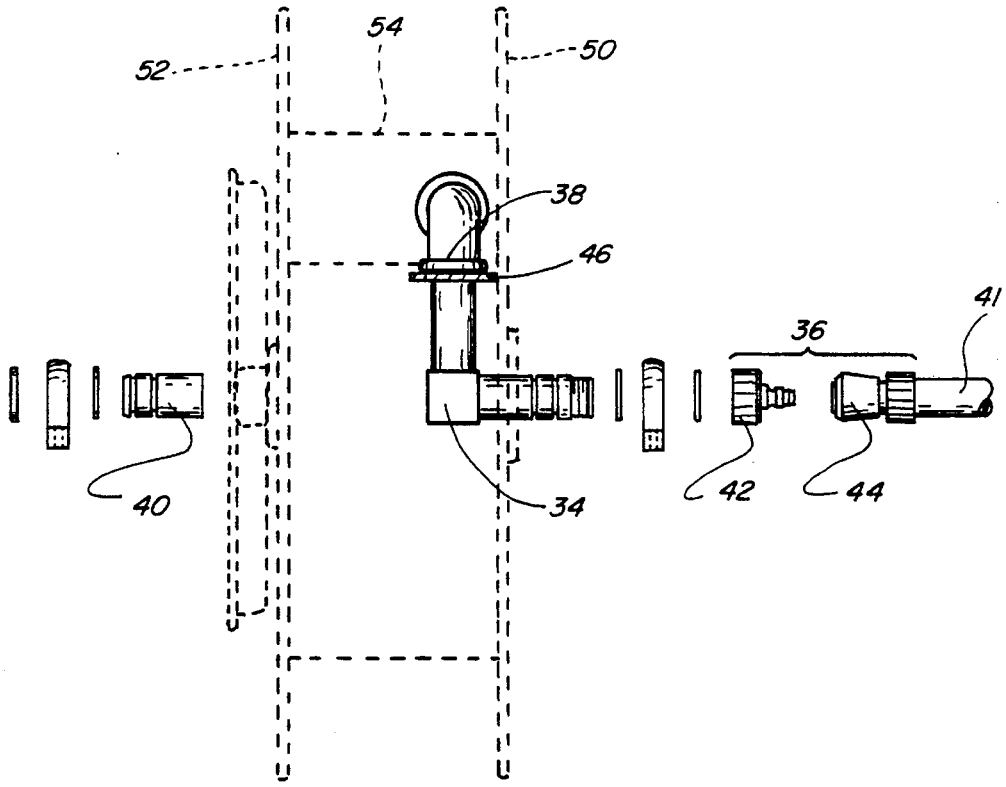
FIG. 4 is a side view of the individual components of the connection member and the components of the axle.

The subject device 10 includes a supportive frame structure 12 which rotatably supports a spool 14. In the preferred embodiment shown in FIGS. 1 and 2, a pair of wheels 16 and 18 are mounted near the rear portion of the bottom of the frame allowing the device to be readily moved from one area to another. The device is moved by holding the handle portion 20 of the frame 12 and tilting the device so that it is supported on the wheels 16 and 18. In addition to the wheels, the frame 12 is shown constructed of a plurality of connected members of a suitable material, with the connected members forming a pair of raised frame members 22 and 24. The frame members 22 and 24 are important as they assist in supporting the spool and, also, raise the spool off the ground. Attached to the frame members 22 and 24 are respective pillow blocks 26 and 28 through which journal means 30 and 32 extend. The journal means 30 on one side of the device rotatably supports a conduit 34 which extends through and outwardly from the journal means 30 for connection to a fitting 36. The fitting 36 is shown in FIG. 4 as a male fitting 42 cooperatively engaging a female fitting 44 on one end of a length of hose, with the male fitting 42 and conduit 34 being rotatable relative to the female fitting. The end of the length of hose opposite the female fitting is connected to a source of water, such as by similar fitting means.

The end of the conduit 34 opposite the fitting 36 extends into the spool 14 and likewise has a fitting 38 that attaches to a mating fitting on one end of a length of garden hose which is to be wound on or off the spool 14. It is important to recognize that the conduit 34 is attached to and rotates with the spool. This means that when a garden hose 39 is connected to the fitting 38 on one end of the conduit, the spool can rotate on the frame with the conduit, while the opposite end of the conduit 34 is connected to a length of hose 41 by means of the engagement between the male fitting member 42 and the female fitting member 44 which is attached thereto. Thus with the present device, it is possible to extend or retract the garden hose 39 onto the spool 14, while the garden hose is connected to a water source enabling it to be used to water the yard or garden. No known device provides means by which a spool is rotatably mounted on a frame structure and is capable of winding in and out a garden hose to a desired length without having to disconnect the device from the source of water. The advantages of the present device are made possible by the fact that the conduit passes through and rotates in the journal means 30 during rotation of the spool in either direction. Also, the fitting connecting the conduit to the source of water is constructed of two portions which can rotate relative to each other.

It is preferable that the fitting 36 be a unit comprised of the male fitting 42 and the female fitting 44. But any snap together fitting forming a coupler may be used as long as the conduit 34 rotates relative to the length of hose 41 and forms a sealed connection therewith. A sealed rotatable coupler is important as water is allowed to pass from the water source to the conduit 34 and to the hose 39, while the conduit and spool rotate on the device 10. Thus, as mentioned previously, a user may wind the garden hose out from the device 10 while connected to a water source. Also, importantly the snap together fitting 36 allows the length of the hose 41 from the water source to the conduit to remain static when the conduit rotates, thus preventing kinking and twisting of the hose connected to the water source.

The journal means 30 and 32 are rotatably connected to the spool 14 by the conduit 34 and an axle 40, with the journal means functioning with the conduit and the axle to rotatably support the spool on the frame 12. Additionally, the conduit is fixedly attached on one end to the spool with the other end of the conduit rotatably passing through the journal means to facilitate connection to a water source. Thus, the conduit rotates in and passes through the journal means, while linking the garden hose to a water source while rotating with the spool. Attached to the other frame member 24 is the pillow block 28 housing the journal means 32 which receives the axle 40, with the axle functioning to support the side of the spool opposite the conduit. Thus, the journal means along with the axle and the conduit function to rotatably support the spool, while allowing the spool to rotate in either direction.

Figure 5:
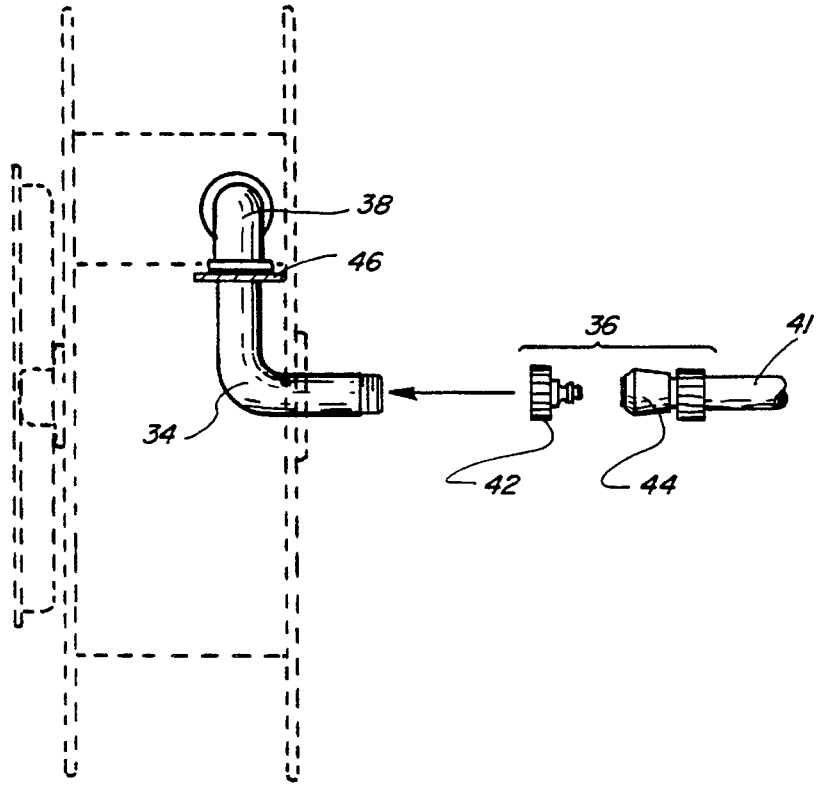
FIG. 5 is a side view showing the conduit as one piece.

The conduit 34 is shown connected to the spool 14 by a connector 46 which is attached to spool sidewall 50. One end of the conduit 34 projects from the drum portion 54 of the spool and has a suitable fitting thereon for attaching one end of a garden hose to be wound onto the drum, the opposite end of the conduit 34 extends through the pillow block 26 and rotates relative thereto as explained above. By attaching the conduit 34 to the spool 14 the two elements can rotate together as a unit. This construction also allows the journal means 30 to support the spool 14 for rotation on one side thereof. The conduit 34 can be made of a variety of materials including metal and plastics and is one of the key elements to enable the subject device to be moved about as required and facilitates withdrawal or rewinding of the hose 39 onto the spool 14 as required. All this can be done while the hose is connected to the water source and without twisting or kinking the hose. The one piece conduit construction 34A shown in FIG. 5 has certain advantages of economy of structure since the conduit 34A is simply a length of tube, shaped to produce the desired result, and mounted for rotation with the spool 14 relative to the pillow block 26.

The spool 14 is designed to accommodate a garden hose or the like and is attached for rotation on the frame 12 as indicated above. The spool should be a sufficient size to accommodate a desired length of hose. The spool as shown has opposed side walls 50 and 52 which are shown circular in shape and each of the side walls has an opening at the center to accommodate the journal means which passes through and supports the spool on the frame 12. The spool also has an annular center portion or drum 54 which is connected between the side walls 50 an 52 and is the element on which the hose is wrapped as it winds and unwinds on the spool 14.

In a preferred embodiment of the present device means are provided for automatically winding the hose 39 onto the spool. When the spool is rotated in one direction, the hose 39 will wind onto the spool and when the drum is rotated in the opposite direction the hose will be extended from the spool to a greater distance. The self winding feature is preferably in the form of a spring assembly 56 that tensions as the spool is rotated in one direction and releases its tension as the spool 14 is rotated in the opposite direction. The spring assembly 56 is attached on one side of the spool to the axle 40. The other side of the spring assembly 56 is attached by a bolt 58 to a spring housing 60. The spring assembly 56 includes the spring housing 60 shown as being circular in shape and mounted concentrically with respect to the axle 40 which passes through the center of the spring housing as shown in FIG. 2.

A pawl assembly 62 is also provided on the subject device on the opposite side of the spool from the spring assembly 56. The pawl assembly 62 may be of conventional construction including having a pawl 68 that rotates with the spool 14 and cooperates with a ratchet wheel 64 that has a plurality of ratchet teeth 66. When the pawl 68 is disengaged from a ratchet tooth 66 the spool is free to rotate under control of the tension of the spring 56 to wind more hose 39 onto the spool 14. The pawl 68 is normally held engaged with a tooth 66 of the ratchet wheel by means of a spring 70 which can be released by the user to free the pawl 68 from the tooth of the ratchet wheel to enable the spool to wind or unwind hose thereon as desired. When the pawl 68 is released from a tooth in the ratchet wheel at a time when the spring 56 is under tension, the spool will rotate in a manner to wind the hose onto the spool 14 unless the user overcomes the force of the spring by pulling on the hose.

Figure 2:
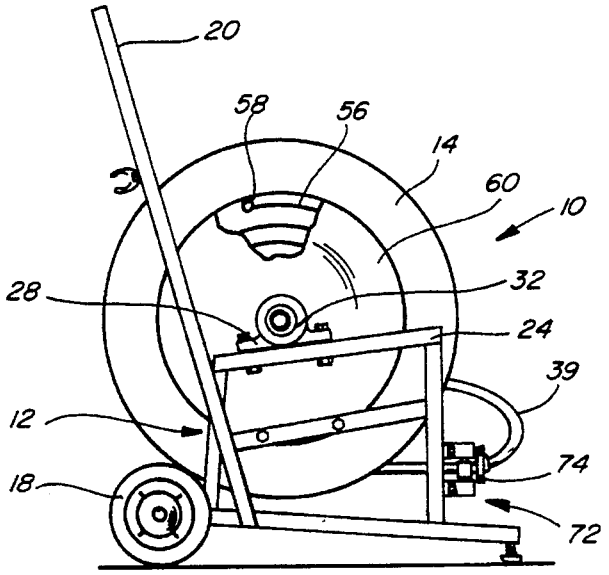
FIG. 2 is a side elevational view of the hose reel device showing the axle and the winding means located on the side of the spool.
Figure 3:
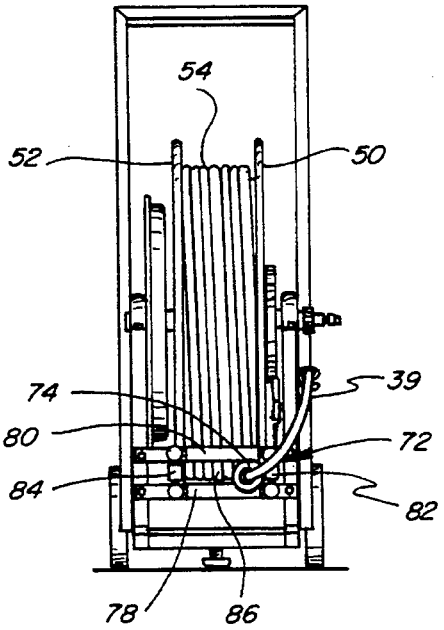
FIG. 3 is a front view of the hose reel device showing the connection member on one side of the spool and the spring mechanism and axle on the other side of the spool.

Referring to FIGS. 1–3 of the application there is also shown, a hose guide assembly 72 which is located on the front end of the frame 12 centrally of the spool 14 and near the bottom of the device. The assembly 72 is formed by four rollers 78, 80, 82 and 84 which form an opening 86 through which the hose extends from the spool 14. The opening is large enough to freely accommodate the hose extending therethrough. An enlargement 74 is attached to the hose external of the subject device. The enlargement 74 is large enough so that it will not pass between the rollers 78 and 80 and therefore will not permit the hose 39 to completely wind onto the spool under spring tension. The assembly 72 also serves as a guide for the hose as it is wound onto and pulled off of the spool 14 and helps to maintain a uniform winding pattern on the spool.

The present device operates by allowing the user to easily connect the hose to a water source by a suitable fitting such as described above. Once so attached the device can be moved to a certain desired location for watering the yard or the garden and when so positioned the user can take hold of the hose as it extends through the assembly 72, and after attaching a suitable nozzle or other device to the end of the hose can pull the hose from the spool to the desired length as required. When the desired length has been reached a quick tug on the hose will cause the ratchet and pawl assembly to engage and maintain the hose at that position. After watering at the desired location for a time the user can pull the hose to a further extended position or can release the pawl from the ratchet and enable the spool to wind in the hose to some other desired closer in position. When the device is no longer being used the hose can be rewound onto the spool being limited by the engagement of the enlargement 74 on the hose and the assembly 72 and the hose can then be disconnected from the water source and stored in some suitable position.

Thus, there have been shown and described several embodiments of a novel hose reel device which fulfills all of the objects and advantages sought therefor. Many changes, variations, modifications and other uses and applications of the present device will, however, become apparent to those skilled in the art after considering this specification and the accompanying drawings. All such changes, variations, modifications and other uses and applications which do not depart from the spirit and scope of the invention are deemed to be covered by the invention which is limited only by the claims which follow:

What is claimed is:

1. In a device for supporting a spool on which a garden hose or the like can be wound including a frame structure having means for rotatably supporting a spool on which a hose can be wound, journal means rotatably supporting the spool on the frame structure, a conduit fixedly attached to the spool for rotation therewith the conduit having a portion extending axially through the journal means on one side of the spool, one end of the conduit having a first fitting for connection to a mating fitting on one end of the hose to be wound on the spool and an opposite end having a second fitting on the end thereof, the second fitting including a portion of a snap together fitting having relatively rotatable male and female portions, the male portion rotatably cooperating with the female portion for connection to a source of water, rotation of the spool changing the length of hose extending therefrom and producing relative rotational movement between the male and the female portions of the second fitting.

2. The device of claim 1 wherein the conduit is of a one piece construction.

3. The device of claim 1 wherein the conduit is of multi-piece construction.

4. The device of claim 1 wherein wheels are attached to the frame.

5. The device of claim 1 wherein an upward extending handle is attached to the frame.

6. The device of claim 1 including a spring assembly connected between the frame and the spool, such that the spring assembly is tensioned when the spool is rotated in one direction and releases tension when the spool is rotated in the opposite direction.

7. The device of claim 6 including a pawl assembly including a pawl that rotates with the spool, a ratchet wheel having plurality of teeth that receives the pawl, with the pawl engaging the ratchet teeth thereby preventing the tension in the spring assembly from rotating the spool and winding in the hose.

8. The device of claim 1 wherein a hose guide assembly formed by four rollers is located on the frame and an enlargement attached to the hose, the enlargement being unable to pass between the rollers thereby preventing the hose from completely winding onto the spool.

9. The device of claim 1 wherein the spool has an annular portion connected between a pair of spaced sidewalls of sufficient size to accommodate a desired length of hose.

10. The device defined in claim 1 wherein the female portion of the second fitting is connected to a length of hose for connecting the device to a water source.

11. An apparatus for winding and unwinding a hose, such as a garden hose including a frame, a spool mounted for rotation on the frame, spring means and latch-pawl means enabling predetermined lengths of the hose to be extended from the spool, means for attaching one end of the hose for connection to a source of water, the improvement comprising a conduit mounted on the spool for rotation therewith and having a first end for connection to one end of the hose wound on the spool and an opposite end extending axially through the journal means that rotatably supports the spool on the frame whereby the conduit rotates with the spool when the spool is rotated on the frame, one end of the conduit extending from the journal and having a fitting mounted on the end thereof externally of the frame, said fitting including a snap together fitting having first and second relatively rotatable portions, the first and second portions rotating relative to one another when the spool is rotated on the frame.

* * * * *

UNITED STATES PATENT AND TRADEMARK OFFICE

CERTIFICATE OF CORRECTION

PATENT NO. : 5,520,212
DATED : May 28, 1996
INVENTOR(S) : Ray F. Williams

It is certified that error appears in the above-indentified patent and that said Letters Patent is hereby corrected as shown below:

Column 6, line 20, "having" insert --a--.

Signed and Sealed this

Tenth Day of September, 1996

*Attest:*

BRUCE LEHMAN

*Attesting Officer*

*Commissioner of Patents and Trademarks*